US007389985B2

(12) United States Patent
Schaefer et al.

(10) Patent No.: US 7,389,985 B2
(45) Date of Patent: Jun. 24, 2008

(54) TRAY LOCKING SYSTEM FOR ACCEPTING SHEETS

(75) Inventors: Charles Schaefer, Churchville, NY (US); Sean Parry, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 427 days.

(21) Appl. No.: 11/095,999

(22) Filed: Mar. 31, 2005

(65) Prior Publication Data

US 2006/0220308 A1 Oct. 5, 2006

(51) Int. Cl.
*B65H 29/00* (2006.01)

(52) U.S. Cl. ..... 271/288; 271/289; 270/52.03; 270/58.01

(58) Field of Classification Search ..... 271/298, 271/279, 288; 270/52.03, 58.01
See application file for complete search history.

(56) References Cited

U.S. PATENT DOCUMENTS

| | | | | | |
|---|---|---|---|---|---|
| 4,561,765 | A | * | 12/1985 | Masuda | 399/367 |
| 4,720,860 | A | * | 1/1988 | Weiss | 713/184 |
| 5,270,773 | A | * | 12/1993 | Sklut et al. | 399/20 |
| 5,308,058 | A | * | 5/1994 | Mandel et al. | 271/289 |
| 5,328,169 | A | | 7/1994 | Mandel | |
| 5,752,697 | A | | 5/1998 | Mandel | |
| 5,974,234 | A | | 10/1999 | Levine et al. | |

* cited by examiner

*Primary Examiner*—Kaitlin S Joerger
(74) *Attorney, Agent, or Firm*—Pillsbury Winthrop Shaw Pittman LLP

(57) ABSTRACT

A multi-bin sheet collection system comprising at least one secured stacking bin operatively configured to secure imaged sheets from general purview.

22 Claims, 2 Drawing Sheets

TRAY LOCKING SYSTEM FOR ACCEPTING SHEETS

BACKGROUND

All references cited in this specification, and their references, are incorporated by reference herein where appropriate for appropriate teachings of additional or alternative details, features, and/or technical background.

Disclosed in embodiments described herein is a security output stacker tray system that allows for a changeable lock to be generated for one or more lockable trays in the stacker system upon request for confidential treatment of output. Also disclosed in embodiments is a security output stacker tray operatively associated with a hardcopy disposal device such as a shredder that is activated after a set period of time to dispose of output in the security output stacker that has not been collected with such set period of time.

Remote printing of documents, whether through a copier, printer or other imaged sheet production devices, is known. Remote shared user printing and mailbox systems in which various users can send their electronic print jobs from different locations to be printed at the shared remote printer are also known. The problem of sorting, that is ordering a print job, and then stacking such print jobs, is made more complex by remote printing in particular when more than one print request is received at a time. Remote printing also suffers from the inability of persons to avoid their output being read, or even accidentally taken, by other users, or commingled together into one stacking tray.

A problem associated with shared remote imaged sheet production device use is that job output may become mixed up, or accidentally removed by others, even if the jobs are initially offset. Such problem has led to some users using manual mailboxes, like Post Office boxes, adjacent the imaged sheet production device with the boxes labeled with different user names for manual job sorting.

To avoid the need for manual job sorting, some systems make use of "mailboxing" wherein a particular output tray or shelve is temporarily or permanently assigned a unique and predetermined electronic address enabling a particular user's output of one or more jobs to be directed into a particular bin or bins assigned to the user. That is, multiple print jobs from a printer, copier, user terminals, fax, network image device, scanner etc., are separated by user and the hardcopy outputted into individual bins for individual users or user groups. The user is then informed of which bin in the mailbox unit the job can be located. The system may be programmed to electronically recognize the sender or user terminal sending the print job. Hard-copy or sheets produced by remote printing is generally outputted into a non-secure stacker system, that while possibly separating the output from other output by, for example, inserting cover sheets at the beginning and/or end of a print job, does not prevent viewing of the documents produced by persons in the vicinity of the imaged sheet production device.

Some systems include a number of elected or assigned lockable mailboxes in the output stacker into which hard copy print jobs generated by the printer are feed into to protect the documents from viewing by unauthorized persons and to maintain confidentiality. The mailbox system can automatically stack respective print jobs of respective users of the printer into designated mailbox bins designated for the respective users such that the print jobs are secured from reading and removal by other users. The system may also make use of "variable bin assignment" in which many users can share a mailbox unit with a limited number of bins by viable (dynamic) bin assignment based on the availability of a bin, that is whether the bin has room for the output, rather than a fixed, permanent assignment of certain bins to certain users or customers. Variable bin assignment increases the effective capacity or the number of potential shared users. Overflow bins may thus be assigned if a subsequent job by the user will not fit into the previously assigned bin or tray. The mailbox bins may be unlocked either with a manual key or electronically by entry of a unique access code for a particular user or group of users and/or the system administrator, that is uniquely assigned to one of the secure stacker trays.

Manual key and unique assigned codes to a bin inherently suffer from security problems themselves. A manual key system inherently relies on an administrator of the system to supply the key to the correct user or to obtain output from the correct bin and supply the output to the correct user. Such system inherently allows the administrator to review the secured documents or any other person with access to the manual key. Unique assigned electronic access codes can be memorized by previous users who can then gain access into the secured bins and review the materials of others.

Security bins also suffer from the need to be periodically purged of material when output is not ultimately or timely retrieved by a user. Security bins must be periodically emptied to allow access to secured bins by other users of the system as the number of security bins is generally limited. Purging is generally assigned to an administrator who is provided a means to access each of the trays. In the purging process the secured output is readily viewable by the administrator, or the person assigned by the administrator to do the purging, and anyone else who happens to review the purged undestroyed documents.

There is need therefore for an improved security bin stacking system that allows for enhanced security of the system.

REFERENCES

U.S. Pat. No. 5,308,058, commonly assigned, discloses a dynamic "mailboxing" unit and system for separating by users the sheet outputs of various users of a shared users' printer. Sheets are staked in separate job sets into one or more temporarily and variably assigned mailbox bins. Privacy doors are provided for restricting access to at least some of the mailbox bins. The doors of the secured bins are electrically unlocked in response to entry of a user access code.

U.S. Pat. No. 5,328,169, commonly assigned, discloses a multi-bin sheet collecting system in which printed sheets are directed to an array of bins for job separation, sorting, and/or user mailboxing. The removal of printed sheet from individual bins is determined by an integral optical transmitter/receiver unit mounted in an aperture in each bin tray in an area to be overlaid by sheets stacked thereon.

U.S. Pat. No. 5,752,697, commonly assigned, discloses a system for remote printing job confidentiality. The system provides for automatic electronic locking of the printer access door as well as the access door on the mailbox system during printing of security sensitive print jobs which are to be stored in a selected bin of the mailbox system. Such locking prevents access to the internal printer paper path, but automatically unlocks the printer access door after the hardcopies have reached the selected mailbox if there is no sheet jam signal. If there is a sheet jam indication, the printer access door is locked until locking system is deactivated by entry of an authorized jam clearance access code.

SUMMARY

Aspects disclosed herein include a system for managing trays for accepting sheets comprising at least one secured output stacking bin operatively configured to conceal outputted sheets, at least one processor for implementing a data instruction set for causing a random passcode to be generated with respect to said at least one secured output stacking bin upon electronic input to produce concealed sheets and for causing said at least one output stacking bin to be remain secured until said random passcode generated is provided to said system;

a multi-bin sheet collection system comprising at least one secured stacking bin operatively configured to conceal imaged sheets, said secured stacking bin operatively associated with a sheet disposal system configured to remove said sheets from said secured stacking bin after passage of a predetermined period of time and to dispose said sheets in a manner so as to obfuscate the image on the sheet;

a device responsive to remote electronic input to produce secured sheet output comprising at least one processor for implementing a data instruction set for causing a random passcode to be generated with respect to said remote electronic input to produce concealed output, and for causing sheet output on an imaged sheet production device upon entering said random passcode into a processor associated with said imaged sheet production device; and a process comprising generating a random passcode in response to electronic input for production of imaged sheets and storage in an electronically lockable bin; setting the electronic lock of a electronically lockable bin to said random passcode; permitting access to said lockable bin upon input of said random passcode into said lockable bin.

BRIEF DESCRIPTION OF THE DRAWINGS

Various of the above mentioned and further features and advantages will be better understood from this description of embodiments thereof, including the drawing figures wherein.

DETAILED DESCRIPTION

Figure 1:
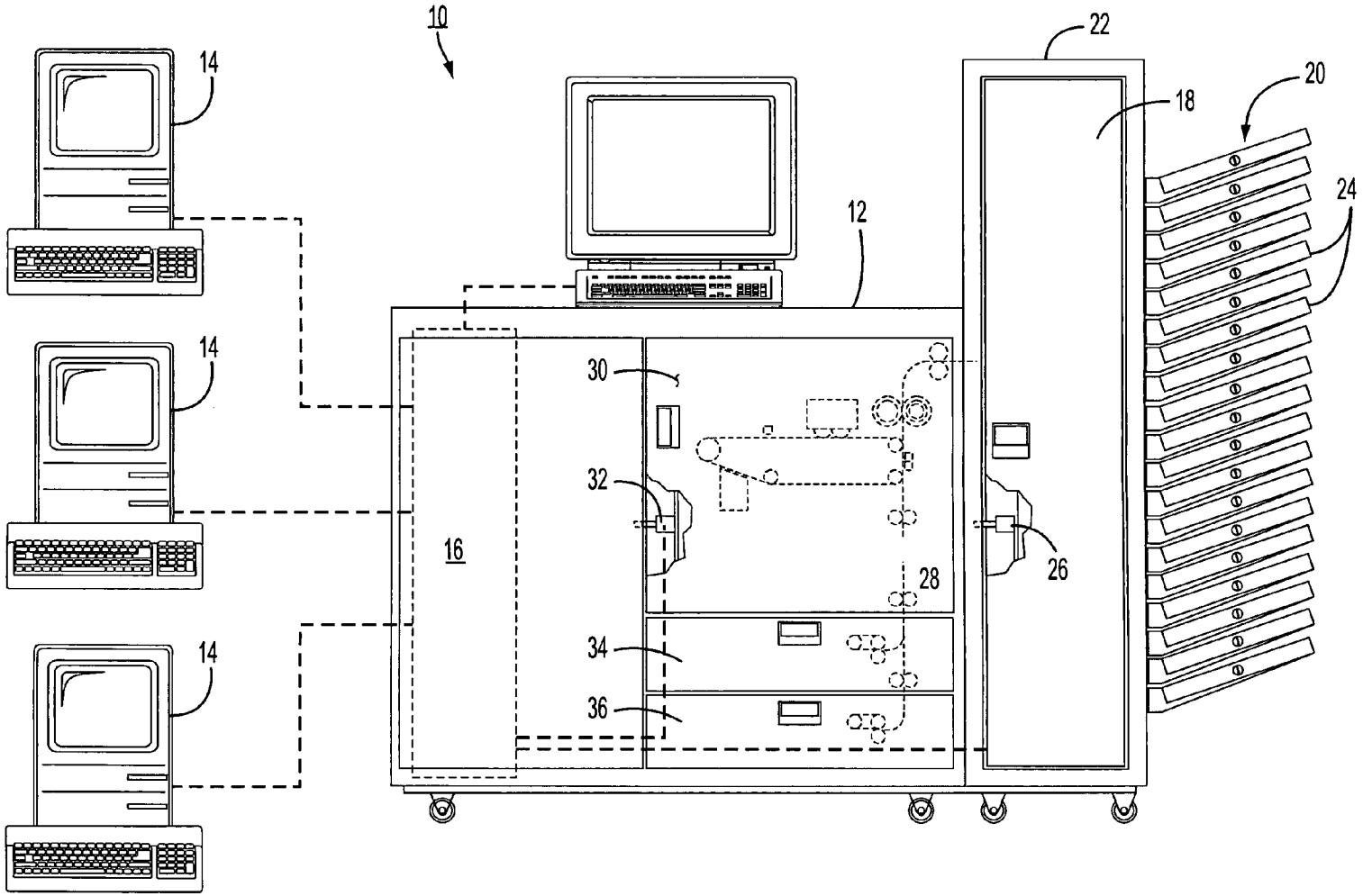
FIG. 1 illustrates a shared users printing and mailboxing system in which there is schematically illustrated a number of remote users sending electronic print jobs from different remote client terminal locations to a single exemplary printer which has one or more lockable output stacker trays and lockable access restricting doors over its internal paper path.

In embodiments there is illustrated a system responsive to remote electronic input to produce secured imaged sheets comprising at least one secured output stacking bin operatively configured to secure said imaged sheets from general purview, at least one processor for implementing a data instruction set for causing a random passcode to be generated with respect to said at least one secured output stacking bin upon electronic input to produce imaged sheets and for causing said at least one output stacking bin to be remain secured until said random passcode generated is provided to said device. By "sheets," it is meant to include paper, transparencies, or any other kind of substrate in sheet form.

The addition of a locking drawer mechanism to one or more bins or slots of a mailbox type stacker allows for provision of physical security for protecting confidential documents. Such security may be compromised when access is provided to the bins using static electronic passcodes or keys. By providing dynamic generation of a passcode, embodiments provide the ability to change the passcode for one or more security bins per job request. The changeable lock code can be programmed into, for example, a lock on the security bin which may be unlocked by entrance of data, as for example, on a keypad associated with the security bin. Such system proffers the advantage of eliminating wait time at a imaged sheet production device, such as a printer or copier, when the person wishing the production of imaged sheets, such as printed documents or photographs, does not want to expend wait time at the production device to prevent unauthorized persons from reviewing the imaged sheets. Opening and closing the bin could deactivate the passcode for the lock and make the bin available for output of another job.

Software or data instruction sets can be provided, for example, that would allow a user to submit confidential material to print to a locked stacker drawer and would return to the user a passcode for the stacker bin lock for the stacker bin in which the material is to be placed. Thus for example, a submitter would be proffered the opportunity to print to a locked stacker drawer and the software would set the combination of the lock and return to the submitter a code to be used to unlock that specific drawer. The submitter then could enter the code on a touch pad and would then be able to unlock the bin and retrieve the material desired. The system may automatically select one or a number of available secured bins into which the imaged sheets will be placed, or may proffer to the user of the system those available secured bins for their selection of bin or bins. The system may provide the submitter with both the passcode and a bin identifier, or the system may contain software that permits the name or other identifier of the submitter to be recorded directly on the selected bin such that the submitter need only know the passcode to open the bin and retrieve the information desired.

The software or data instruction set(s) may be designed to further cause another random passcode to be generated with respect to said at least one secured output stacking bin if such passcode is already associated with one or more secured output stacking bin. Bin selection, or the proffering of bin selections, may be limited by the amount of material which a particular bin may hold, and the actual amount of material being requested to be produced. The random passcode may be associated with more than one secured bin particularly when the requested amount of production would exceed any available bin. A new passcode may not be generated when the same submitter/user submits yet another job for secured storage. In such case, the newly requested material may be placed into the same secured bin as waiting for the submitter, or placed in yet another bin (in particular if there is not enough room in the first bin) associated with the same passcode. In this manner, the submitter need only remember one passcode.

The produced sheets may be print, an image etc. on any form of material, such as plastic, paper, metal sheet, etc, and particularly printed paper. The system may comprise an electrostatographic device, and may optionally comprise a sheet disposal device, such as a shredder, degrader, etc. of sheets which is programmed to act upon the sheets in a particular secured bin after a period of time has elapsed, typically the time allotted to a the submitter to obtain the production output.

A system may generate the random passcode using any of the techniques generally known in the art, for example, using random number tables, or selecting the passcode based on some parameter of input such as the submitters name or address or remote client's ip address.

In embodiments, there is also illustrated a multi-bin sheet collection system comprising at least one secured stacking bin operatively configured to secure imaged sheets from general purview, said secured stacking bin operatively associated with a sheet disposal system configured to remove said sheets from said secured stacking bin after passage of a pre-determined period of time and to dispose said sheets in a manner so as to obfuscate the image on the sheets to general purview.

The disposal system may comprise any of the many systems know to dispose of sheets such as a shredder, a decomposer etc. The fixed media may be degraded in whole or in part with purpose of making it more difficult to determine the printed matter, images etc. that were on the intact sheets. The disposal system may be programmed to remove the secured sheets from the secured bin after the passage of a period of time that was provided to the user of the system/submitter in which to retrieve the sheets from the secured bin. The secured bin may comprise a mechanical and/or electrically lock. The multi-bin sheet collection system may be operationally coupled to any sort of sheet production system, such as an electrostatographic device by which it is meant to encompass without limitation a ink jet printer, a laser printer, a copier, a scanner, or other such devices.

In yet another embodiment, there is illustrated a device responsive to remote electronic input to produce secured sheet output comprising processor(s) for implementing a data instruction set for causing a random passcode to be generated with respect to said remote electronic input to produce secured output, and for causing sheet output on a imaged sheet production device upon entering said random passcode into a processor associated with said imaged sheet production device.

In yet another embodiment, there is illustrated a process comprising generating a random passcode in response to electronic input for production of sheets and storage in an electronically lockable bin; setting the electronic lock of a electronically lockable bin to said random passcode; permitting access to said lockable bin upon input of said random passcode into said lockable bin.

Now turning to the Figures, in FIG. 1 there is illustrated a shared users printing and mailboxing system in which there is schematically illustrated a number of remote users sending electronic print jobs from different remote client terminal locations to a single exemplary printer which has one or more lockable output stacker trays and lockable access restricting doors over its internal paper path. There is shown in this exemplary system 10 a centralized document printer 12 which is being sent electronic documents for printing from document generating terminals 14, The print jobs transmission may be over various communication networks and transmission media, as is well known. The advantages of such centralized shared printer electronic printing over small desktop printers are known including much lower cost per page of printing and much faster printing using the larger printer, and the ability to provide on-line finishing and other hard copy document features of a sophisticated printer. System 10 includes an operatively connecting mailbox system 20 for taking the printed sheets outputted from the printer 12 into a sheet distribution system 22, and with or without finishing, stacking the print jobs for designated users into designated mailboxes. Secure locked bins, or mailboxes, 24 are show, which may be unlocked by users of the mailboxes when the user provides a random passcode generated by the system 10 an which system 10 provides to one or more of the secure bins, or mailboxes, 24 or a decipherable passcode generated from the passcode selected by system 10 by way of algorithm. Printer 12 has its paper path 28 in the upper portion thereof, and that paper path portion of printer 12 is normally covered and access restricted by an access door 30. The access door 30 is normally freely openable for jam clearance or maintenance, except that it may be locked by a latching door lock 32, for example, actuated by a controller (not shown) in printer 12 by software programmable microprocessor therein in particular when a jam is noted of secured material. Appropriate sensors for determining a jam may be located anywhere along paper path 28 or in sheet distribution system 22. The portion of the mailboxing system 20 comprising the sheet distribution system 22 is shown to have an access door 50 which is normally openable for access. This mailboxing system sheet distribution system access door 50 may also be provided with a similarly electronically actuable lock 26. The actuable locks may be authorized to be open only by an appointed administrator who is entrusted with confidential documents.

Figure 2:
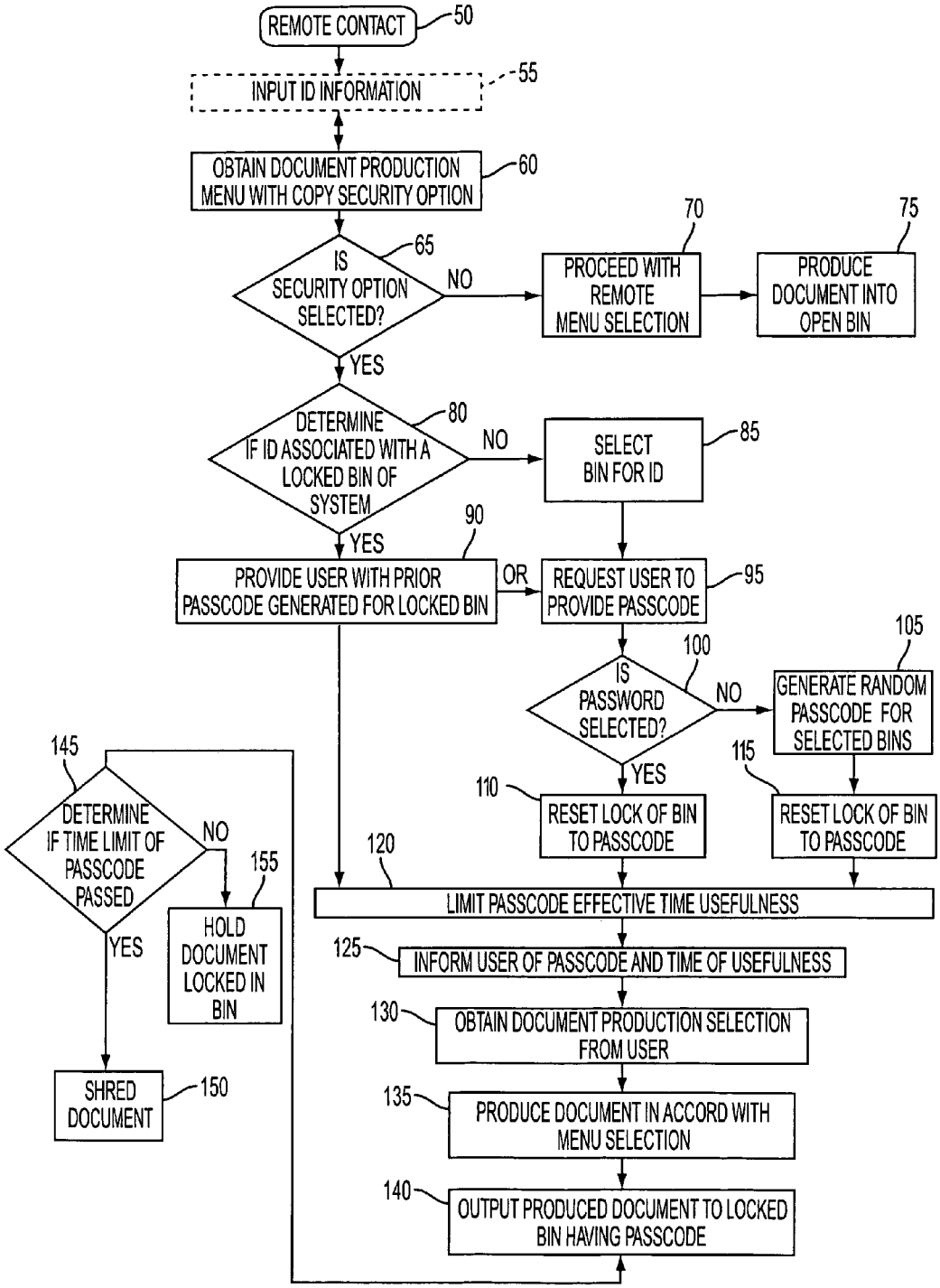
FIG. 2 is a flow chart of an exemplary schematic that may be employed to limit access to a securable stacker tray to a person receiving a random passcode.

Now turning to FIG. 2, there is shown a flow chart of an exemplary schematic that may be employed to limit access to a securable stacker tray to a person receiving a random passcode. Remote contact is made at step 50 and id information is inputted (Step 55). Subsequently a document production menu is provided with a copy security option (Step 60) which provides for produced sheets to be stored in a secured stacker bin. If the security option is selected (Step 65), the identity of locked stacker bins available for storage are determined (Step 85) if the identity of the person or client is not associated with a particular free locked bin, and if the identity of the person or client is associated with a free locked bin (Step 80) the passcode to such free locked bin is provided (Step 90) to the user. When a free locked bin is not generally associated with a particular person or client, either a passcode is the user is requested to provide a passcode of their own choosing (Step 95) or a random passcode is generated for the selected free bin (Step 105). Whether the passcode is selected (Step 100) by the user's own choosing or generated randomly the lock of the appropriate bin is reset to the passcode (Steps 110 and 115). Optionally the passcode useful is limited to a certain time period (Step 120) and such limited time period is communicated to the user (Step 125). The document or other fixed media document production selections are obtained from the user (Step 130) and the document produced in accord with the menu selection (Step 135). The outputted produced document or other sheet is then stored in the secured bin having the selected passcode (Step 140). The document or other fixed medium is then made available to the user for a fixed time period by inputting the selected passcode. Optionally if the system determines that the time limit of the passcode has passed (Step 145), then the document may be shredded (Step 150) or otherwise disposed. If the time limit of the passcode has not passed the document is maintained in the locked security bin (Step 155). Instead of automatic disposing of the document or sheets by coupling with a shredder or other disposing device, the administrator of the system may be provide with notice of material in the security bin after an authorized period, and be prompted to remove the material. If the security option is not selected, the remote menu screen selection is transacted upon (Step 70) and the document or other sheets is produced and placed into the secured bin (Step 75).

A stacker system of this specification may be used with any imaged sheet production device, including printers, copiers, multifunction machines or systems, xerographic or otherwise. The imaged sheets may include any material upon which an image, such as print, may be formed and may be "sheet" material, a thin flat piece of material.

While the invention has been particularly shown and described with reference to particular embodiments, it will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system for managing trays for accepting sheets, comprising:

at least one secured output stacking bin operatively configured to conceal secured output sheets;

at least one unsecured output stacking bin; and at least one processor for implementing data instruction set(s), wherein, if a security option is selected by a user, and if the at least one secured output stacking bin is not associated with the user, the at least one processor is configured to:

cause generation of a randomly-generated passcode associated with the at least one secured output stacking bin, in response to each electronic input request by the user to produce secured sheets, provide the randomly-generated passcode to the user, and cause the at least one output stacking bin to be remain secured until the randomly-generated passcode is provided to the system by the user, wherein said randomly-generated passcode expires after a predetermined period of time, and wherein, if the security option is not selected by the user, the processor is configured to cause production of unsecured sheets into the unsecured output stacking bin.

2. The system of claim 1, wherein the data instruction set(s) further cause another randomly-generated passcode to be generated with respect to said at least one secured output stacking bin if the passcode is already associated with one or more secured output stacking bin.

3. The system of claim 1, wherein the produced sheet is printed paper.

4. The system of claim 1, comprising an electrostatographic device.

5. The system of claim 1, further comprising a sheet disposal apparatus operationally associated with said at least one secured output stacking bin.

6. The system of claim 1, wherein said randomly-generated passcode is associated with more than one secured output stacking bin.

7. The system of claim 1, wherein said randomly-generated passcode is generated based at least in part on the user's IP address.

8. The system of claim 1, wherein said secured output stacking bin is selected in accordance with the input request with respect to the amount of sheets to be produced and secured.

9. A multi-bin sheet collection system, comprising:

an unsecured stacking bin, wherein, if a security option is not selected by a user, unsecured sheets are produced into the unsecured stacking bin;

at least one secured stacking bin operatively configured to conceal imaged sheets, wherein, if the security option is selected by the user, the imaged sheets are provided in response to entry of a randomly-generated passcode by the user, the randomly-generated passcode being supplied to the user in response to each request by the user to produce a secured sheet output, wherein said randomly-generated passcode expires after a predetermined period of time; and a sheet disposal system operatively associated with the at least one secured stacking bin and configured to remove said sheets from said at least one secured stacking bin after passage of the pre-determined period of time and to dispose said sheets in a manner so as to obfuscate the image on the sheets.

10. The multi-bin sheet collection system of claim 9, wherein the disposal system comprises a shredder.

11. The multi-bin sheet collection system of claim 9, wherein the disposal system disposes of the fixed media by degrading it in whole or in part.

12. The multi-bin sheet collection system of claim 9, wherein disposal system is configured to remove said sheets from said secured stacking bin after passage of a period of time provided to a user of the system in which to retrieve their fixed media.

13. The multi-bin sheet collection system of claim 9, wherein the at least one secured stacking bin operatively configured to secure imaged sheets is an electronically-lockable bin.

14. The multi-bin sheet collection system of claim 9, wherein the at least one secured stacking bin operatively configured to secure imaged sheets is an mechanically-lockable bin.

15. The multi-bin sheet collection system of claim 9, wherein the system is operationally coupled to an electrostatographic device.

16. A device responsive to remote electronic input to produce secured sheet output comprising:

at least one processor for implementing a data instruction set, wherein, if a security option is selected by a user, the at least one processor is configured to cause generation of a random passcode in response to each remote electronic input request by the user to produce a secured sheet output;

provide the random passcode to the user; and cause one or more sheets to be securely outputted on a imaged sheet production device, in response to entry of the random passcode by the user into a processor associated with said imaged sheet production device, wherein said random passcode expires after a predetermined period of time, and wherein, if the security option is not selected by the user, the at least one processor is configured to cause production of one or more unsecured sheets on the imaged sheet production device.

17. The device of claim 16, wherein the data instruction set further cause another randomly-generated passcode to be generated with respect to the secured output stacking bin if the passcode is already associated with one or more secured output stacking bin.

18. The device of claim 16, wherein the produced sheet is printed paper.

19. The device of claim 16, wherein said device is an electrostatographic device.

20. The device of claim 16, wherein said random passcode is generated based at least in part on the user's IP address.

21. The system of claim 1, wherein said randomly-generated passcode is generated based at least in part on a submitter's name.

22. The device of claim 16, wherein said random passcode is generated based at least in part on a submitter's name.

* * * * *